United States Patent [19]

Barker

[11] 4,065,294

[45] Dec. 27, 1977

[54] ENERGY CONSERVING PROCESS FOR PURIFYING IRON OXIDE

[75] Inventor: James E. Barker, Blue Ridge, Ga.

[73] Assignee: Cities Service Company, Tulsa, Okla.

[21] Appl. No.: 735,228

[22] Filed: Oct. 19, 1976

Related U.S. Application Data

[63] Continuation-in-part of Ser. No. 591,260, June 30, 1975, abandoned.

[51] Int. Cl.[2] ..... C22B 1/08

[52] U.S. Cl. ..... 75/3; 75/1 R; 75/5; 428/39; 428/97; 428/107

[58] Field of Search ..... 75/1, 2, 111, 113, 3, 75/6, 7, 112; 423/76, 79, 88, 96, 97, 107, 133, 149, 38, 39

[56] References Cited

U.S. PATENT DOCUMENTS

| | | | |
|---|---|---|---|
| 933,270 | 9/1909 | Schumacher | 75/3 |
| 958,700 | 5/1910 | Glass | 75/3 |
| 2,245,076 | 6/1941 | Muskatt | 423/79 |
| 3,482,964 | 12/1969 | Ishimitsu | 75/3 |
| 3,988,417 | 10/1976 | Polinsky | 75/114 |

FOREIGN PATENT DOCUMENTS

| | | | |
|---|---|---|---|
| 548,145 | 9/1942 | United Kingdom | 75/113 |

*Primary Examiner*—L. Dewayne Rutledge
*Assistant Examiner*—Michael L. Lewis
*Attorney, Agent, or Firm*—Donald L. Traut

[57] ABSTRACT

Chemical waste by products are used in place of conventional heating fuels both for induration and chloridization of impure iron oxide. Pelletized iron oxide is hardened and purified simultaneously by exposure to the heat and combustion products generated from burning chlorinated organic by-products. Hydrogen chloride produced during this combustion reacts with trace metal impurities in the iron oxide to effectively remove substantially all such impurities as volatile metal chlorides. Conventional fuel and binder requirements are substantially reduced or completely eliminated through use of such by-products, while remedying the problem of their disposal.

27 Claims, No Drawings

ENERGY CONSERVING PROCESS FOR PURIFYING IRON OXIDE

BACKGROUND OF THE INVENTION

This is a continuation-in-part application of my copending application Ser. No. 591,260, filed June 30, 1975, now abandoned.

FIELD OF THE INVENTION

This invention relates generally to a process for purifying iron oxide, and more particularly, to an improved method for removing trace or "tramp" metals from pelletized iron oxide.

In addition to the foregoing, the present invention advantageously conserves energy by reducing or completely eliminating the need for conventional forms of fuels commonly empolyed with earlier methods.

DESCRIPTION OF THE PRIOR ART

In the process of roasting sulfur-containing concentrates isolated during the separation of iron, zinc and copper bearing ores, oxides of iron are formed when the concentrates are burned to drive off the sulfur. These oxides are an important source of iron, since they contain large quantities of the material. However, it is necessary to remove as much of the metal impurities as possible from these oxides before they can be employed as useful raw materials for steel manufacturing.

Heretofore, in the purification of pelletized iron oxide, calcium chloride or other like materials would be incorporated into the oxide as the sole chloridizing agent prior to induration. The pellets were dried and heated up to temperatures as high as 1250° C to volatilize the trace metal impurities, e.g. copper, lead, zinc, etc., as metal chlorides and to increase the physical strength of the pellets. Consequently, large quantities of both calcium chloride and costly conventional heating fuels, in short supply, have been required. One such process is disclosed in U.S. Pat. No. 3,482,964.

It has now been discovered that high quality iron oxide, substantially free of all trace or "tramp" metal impurities can be prepared by eliminating virtually all use of costly conventional heating fuels and continuous purchase requirements of special chloridizing agents. In addition to providing a means for conserving fuel, the instant invention also offers a solution to a troublesome by-product disposal problem through the constructive application of chemical by-product materials to an improved metallurgical process.

Accordingly, it is the principal object of the present invention to provide an improved process for preparing iron oxide that is substantially free of trace metal impurities.

It is a further object of the present invention to provide a metallurgical process wherein chemical by-products function simultaneously as both the heating fuel and chloridizing agent for purifying and hardening iron oxide pellets.

A still further object of the present invention is to provide an energy conserving process for preparing high grade iron oxide where conventional heating fuels and chloridizing agent requirements are substantially reduced or completely eliminated.

One additional object is to provide an ecologically acceptable means for disposing of large quantities of industrial chlorinated hydrocarbon by-products without adverse affects of the environment.

These and other objects, features and advantages will become apparent to those skilled in the art after a reading of the following non-detailed description.

SUMMARY OF THE INVENTION

The present invention relates to an improved metallurgical process wherein substantially all trace metal impurities are eliminated from iron oxide.

Broadly, the invention is concerned with the process for the purification of iron oxide having trace metal impurities of copper, lead, zinc, gold, silver, bismuth, etc., normally using conventional fuels and conventional chlorinating agents and having the steps of (a) adding to the iron oxide a sufficient amount of binder, (b) pelletizing the resulting mixture, (c) drying the pellets, and (d) indurating the pellets to a temperature ranging from about 1200° C to about 1250° C and concurrently chlorinating the pellets using a conventional chlorinating agent. The improvement comprises indurating and concurrently chlorinating the pellets using heat and chlorine values generated by combustion of a chlorinated hydrocarbon fuel or a blended chlorinated hydrocarbon fuel. The chlorinated hydrocarbon fuel comprises a mixture of organic compounds having a heat of combustion of at least 11,000 BTU/pound and having a combined elemental analysis of about 56%–87% carbon and about 9%–15% hydrogen, and about 1% –35% chlorine. One example of a blended chlorinated hydrocarbon fuel mixture comprises a highly chlorinated hydrocarbon fuel having a heat of combustion of about 11,000 BTU/pound and a sufficient amount of partially chlorinated hydrocarbon fuel to increase the heat of combustion of the final blended fuel mixture to at least 12,000 BTU/pound. A second example of a fuel mixture comprises a highly chlorinated hydrocarbon fuel having a heat of combustion of at least 4,000 BTU/pound and a sufficient amount of fuel oil to provide the final blended mixture with a heat of combustion of at least 12,000 BTU/pound. The highly chlorinated hyrocarbon fuel is comprised of a mixture of organic compounds having a combined elemental analysis of about 28%–56% carbon, about 2%–8% hydrogen, and about 36%–70% chlorine. The partially chlorinated hydrocarbon fuel comprises an elemental analysis of about 56–87% carbon, 9%–15% hydrogen, and about 1%–35% chlorine. Both chlorinated hydrocarbon fuels as described herein may also contain minor amounts of sulfur, oxygen, nitrogen, ranging up to about 2%.

The chlorinated hydrocarbon fuels employed in the disclosed process are chemical waste by-products generated in the manufacture of chlorinated organics. Rapid expansion in chlorinated organics by industry has resulted in large quantities of chlorinated organic by-products being generated in plants involved in the manufacture of acetone, vinyl chloride monomer, caprolactam, acetaldehyde, chloroprene and carbon tetrachloride. In the production of these products, chlorine reacts with organic chemicals such as acetylene, benzene, ethylene, methane or toluene to make intermediates that can be used in paints, plastics, synthetic rubber, herbicides, dry cleaning agents, soaps, and the like. In producing intermediate chemicals, however, side reactions take place during chlorination resulting in undesirable impurities which must then be removed. Methods of disposing of these chlorinated organic by-products have involved dumping, incineration or discarding at sea, but anti-pollution regulations enacted now prohibit such methods of disposal. One such example of incineration at sea is noted in *Chemical & Engineering News,* Nov. 18, 1974, p. 43.

The specific composition of the chlorinated hydrocarbon fuels and the molecular identity of their individual components are not critical to the practice of the invention, as long as the fuel composition is combustible by itself or is combustible when mixed with conventional fuel oils, and supplies sufficient heat and combustion products that include at lease about 0.1% hydrogen chloride.

Generally, however, the partially chlorinated hydrocarbon fuel compositions of the present invention having the above elemental analysis with chlorine values ranging from about 1% to 35% by weight are kerosene type solvents, which include various alcohols and chlorinated hydrocarbons. The preferable fuels belonging to this class have been found to provide a heat of combustion of 11,000 BTU/pound to about 19,000 BTU/pound of fuel. The heat generated by such fuels is approximately inversely proportional to the total chlorine content of the fuel. That is to say, as the chlorine content of the fuel increases, the heat of combustion decreases.

Correspondingly, partially chlorinated hydrocarbon fuels having 35% or less chlorine do not produce as high a volume of hydrogen chloride as higher chlorine containing fuels. Thus, the present invention also contemplates the use of highly chlorinated hydrocarbon fuel also comprising a mixture of organic compounds, but with a combined elemental analysis of about 28% to about 56% carbon, about 2% to about 8% hydrogen and about 36% to about 70% chlorine. Such fuels are capable of generating up to 10% or more by volume of hydrogen chloride. Here, as in the case of the partially chlorinated hydrocarbon fuels, the specifics of molecular identity of the individual component ingredients of the highly chlorinated hydrocarbon fuels are not critical to the successful practice of the invention. Obviously, the composition of each fuel will vary depending upon the particular chlorinated organic being produced and the process employed in its production. However, highly chlorinated hydrocarbon fuels have typically been found to comprise a mixture of about 30% to 40% 1,1,2, trichloroethane, about 1% to 5% ethylene dichloride and a number of isomers of chlorobutanes.

The highly chlorinated hydrocarbon fuels having 36% to about 70% chlorine provide a heat of combustion of under 11,000 BTU/pound, and more specifically, from about 4,000 BTU/pound to under about 11,000 BTU/pound of fuel. Generally, those fuels having more than about 40% chlorine do not always provide the desired flame temperatures of at least about 1200° C, and more preferable, about 1425° C to about 2100° C, for the most efficient rate of chloridization and induration of the iron oxide. As a result, it may be desirable to support combustion of a lower heat producing, highly chlorinated hydrocarbon fuel with oxygen enriched air, or more preferably, with a supplemental fuel in order to obtain a flame having the most desirable heat characteristics. Suitable supplemental fuels that may be incorporated into the chlorinated hydrocarbon fuels that are deficient in their heat producing characteristics comprise various fuel oils and/or the partially chlorinated hydrocarbon fuels described above which offer better heat producing properties.

As previously indicated, partially chlorinated hydrocarbon fuels having from about 1% to 35% chlorine have a heat of combustion ranging from about 11,000 to about 19,000 BTU/pound. A sufficient amount of the partially chlorinated hydrocarbon fuel may be blended in with the highly chlorinated hydrocarbon fuel to provide a fuel mixture with a heat of combustion of at least about 12,000 BTU/pound.

As an alternative, a sufficient amount of fuel oil may be mixed with the highly chlorinated hydrocarbon fuel to impart a heat of combustion of at least 12,000 BTU/pound to the final blended fuel. For purposes of the present invention, fuel oil comprises any suitable petroleum product or mixtures of such products which burn to generate heat, exclusive of oils with a flash points below 38° C. Examples of suitable fuel oils are heating oils, stove oils, furnace oils, bunker oils, and the like.

Another embodiment of the present invention includes supplementing the highly chlorinated, lower heat producing hydrocarbon fuels disclosed herein with a sufficient amount of the partially chlorinated hydrocarbon fuel possessing higher heats of combustion and with a lesser amount of fuel oil. The objective is to blend an economical fuel and correspondingly optimize its heat and hydrogen chloride gas producing properties by blending into such fuels greater volumes of less costly, freely available partially chlorinated hydrocarbon fuels and topping off the mixture with minimal amounts of costlier fuel oils. For example, a highly chlorinated hydrocarbon fuel having an elemental analysis of about 60% by weight chlorine and a heat of combustion of about 5000 or 6000 BTU/pound may be blended with a sufficient amount of a partially chlorinated hydrocarbon fuel having about 1 or 2% chlorine and a heat of combustion of 18,000 to 19,000 BTU/pound to provide a fuel having at least about 12,000 BTU/pound and about 18% chlorine. The mixture may be blended further with a lesser, but sufficient amount of #2 or #6 fuel oil to increase its heat producing properties to at least about 14,000 BTU/pound.

The above described fuels are miscible with each other. However, a layer of solids or sludge may develop due to crystallization of certain higher alcohols. Heating the fuel to above 49° C will redissolve the solids.

Iron oxide as used herein encompasses both ferric and ferrous iron, as well as magnetite and other forms of iron oxides. Generally, oxides treated according to the disclosed process are composed predominantly of ferric oxide, and more specifically, ferric oxide in amounts ranging usually from about 70% to about 99%. The numerous iron oxides that may be satisfactorily treated according to the invention include, for example, iron oxide dusts and powders recovered during roasting of iron sulfide concentrates, roaster calcine, waste heat boiler solids and various mixtures of materials collected from hot gas cooling during iron roasting and various mixtures thereof. Iron oxide also encompasses naturally occurring impure iron oxide ores.

Prior to chloridization and induration, a sufficient amount of calcium chloride, ferrous chloride, calcium hydroxide, calcium oxide, silica, fayalite slag and mixtures thereof may be incorporated into the iron oxide as a binder. Preferably, from about 3% to about 7% calcium chloride is added to the iron oxide which is then agglomerated into "green" pellets for simultaneous induration and chloridization. In addition to the calcium chloride, about 1 or 2% calcium hydroxide, with 2% to about 4% smelter slag or other silica bearing material, may be added to the iron oxide as a high temperature binder.

The pelletized iron oxide is dried and fed into any suitable direct heating vessel, such as a fluidized bed reactor or vertical shaft furnace. However, a continuous feeding rotary kiln has been found specially adaptable to the instant process. Pellets entering the heating vessel have a residence time of about 1 to 2 hours and are exposed directly to an oxidizing flame having a temperature, preferably of at least 1425° C, generated by the combustion of the foregoing fuel, which also emits high energy ionized chloride gases onto the pellet bed to react with the trace metal impurities in the iron oxide. The impurities evolve and are removed as volatile metal chlorides in the gas phase, and the pellets are simultaneously indurated by the heat of combustion. The off-gases are scrubbed with water to remove the metal chlorides and excess hydrogen chloride, thereby, reducing air pollution. The scrubber liquor is neutralized with calcium carbonate or calcium hydroxide to precipitate the metals and generate calcium chloride for recycling. The regenerated calcium chloride solution is concentrated by evaporation and is again available for incorporation into green pellets prior to firing.

The quantity of calcium chloride used in the instant process is less than required by other methods, since the principal chloridizing agent is derived from the combustion gases of the chlorinated hydrocarbon fuel. Furthermore, any chloride lost in the system can be compensated for by adjusting the chloride content of the fuel to make up for the losses taking place in the system. About 85% of the chloride is recovered as calcium chloride which is available for recycle purposes, and the 15% of the chloride lost in the finished pellet and gas treatment system is compensated for by employing a chlorinated hydrocarbon fuel having a sufficient level of chlorine to balance the system. Thus, the amount lost in the system is simultaneously generated as recycle material. Accordingly, the need for make up calcium chloride can be totally eliminated once the system is balanced.

As indicated above, no special devices or equipment are required for treating iron oxide according to the disclosed process. Conventional heavy oil combustion equipment may be used without modification. Because the chlorinated hydrocarbon fuels have a tendency to form gums and deposits at high temperatures, these fuels should be maintained at as low a temperature as practical (at least less than 300° F) until atomized into the combustion zone.

The following specific examples demonstrate the process of the instant invention. However, it is to be understood that these examples are for illustrative purposes only and do not purport to be wholly definitive as to conditions and scope.

EXAMPLE I

About 1700 kg. iron calcine produced by roasting pyrite ore in a fluidized bed roaster, was blended with about 79 kg. calcium chloride and 207 kg. water, to adjust the moisture content for balling. This mixture was stored at ambient temperatures for 8 hours to cure. An additional 8.7 kg. of calcium chloride together with 56 kg. silica and 18.6 kg. hydrated lime were blended into the iron calcine using a pug mill, ground and mixed thoroughly in a ball mill, and finally pelletized on a one meter pelletizing disc, inclined at 49° and rotated at about 14 rpm. The moisture content of the pellets was adjusted further by spraying water onto the pelletizing disc in a sufficient amount to maintain the crushing strength of the pellets at 3.5 kg/pellet and a size measuring 13 to 15 mm in diameter. The pellets were then dried in a conveyor dryer at a maximum temperature of 250° C for about 40 minutes.

The dried iron oxide pellets prepared according to the foregoing procedure were labeled batch No. 1, and contained on the average 4.7% calcium chloride, about 1% lime hydrate and 3% silica. Two additional batches of dried iron oxide pellets were prepared and labeled samples No. 2 and No. 3, each containing on the average 4.4% and 4.6% respectively of calcium chloride.

Samples of dried pellets from each of the batches Nos. 1, 2 and 3 were analyzed for copper, lead and zinc by atomic absorption methods and for sulfur by combustion in a Leco IR 32H Sulfur Determinator prior to chloridization and induration. Table A below provides the chemical analysis of trace metals contained in pellet samples 1–3 prior to chloridization and induration:

TABLE A

| | Chemical Analysis of Dried Pellets (%) | | | | |
|---|---|---|---|---|---|
| Sample No. | Cu | Pb | Zn | S | $CaCl_2$ |
| 1 | 0.720 | 0.280 | 0.602 | 0.70 | 4.7 |
| 2 | 0.726 | 0.302 | 0.631 | 0.73 | 4.4 |
| 3 | 0.814 | 0.252 | 0.606 | 0.70 | 4.6 |

The dried "green" pellets were then fed by a vibrating feeder at a rate of about 160 to 170 kg/hour into double diameter rotary kiln (60 cm – 70 cm) inclined at 2° and rotating at a speed of 0.8 rpm. The kiln was fired with an air-atomizing straight type burner stationed at the discharge end of the kiln and aimed essentially down the center toward the feed end.

A first series of tests were conducted using the above described straight type burner, chloridizing and indurating samples 1–3, which correspond to tests 1–3 respectively. Test No. 1 was conducted using a conventional Grade No. 4 heavy fuel oil (Fuel R). Test No. 2 of the first series was conducted with a chlorinated hydrocarbon fuel having a elemental analysis of about 20.0% chlorine, about 70.0% carbon and about 10.0% hydrogen, and a heat of combustion of 15,100 BTU/-pound (Fuel R'). The fuel used in Test No. 3 (R") consisted of a mixture of R' fuel (60%) blended with R fuel (40%) to provide a chlorine content of about 12.8 weight percent and a heat of combustion of 16,700 BTU/pound.

The analytical procedures used in chemical analysis of the chlorinated hydrocarbon fuels e.g. R' and R" may be any suitable methods known to the art, such as those contained in the text *Organic Quantitative Microanalysis* by Niederl and Niederl, Second Edition, John Wiley and Sons, New York, 1942, pages 101 through 181.

In tests 1–3 the "green" pellets were fed into the kiln for chloridizing and induration countercurrent to the flame. 100% excess air was used with the foregoing test fuels for combustion to maintain an oxidizing atmosphere and to maintain the flame as short as practical. Kiln temperatures ranged from as low as 410° C at the feed end to highs of up to 1185° C at the discharge end. Residency time for the pellets in the kiln was 1 hour and 20 minutes.

Pellets discharged from the kiln were cooled and analyzed for copper, lead, zinc and sulfur content. Table B provides the chemical analysis of the remaining trace metals contained in test samples 1–3 subsequent to chloridization and induration:

TABLE B

| Sample (Test) No. | Fuel | Chemical Analysis of Treated Pellets (%) Cu | Pb | Zn | S | $CaCl_2$ |
|---|---|---|---|---|---|---|
| 1 | R | 0.062 | 0.019 | 0.022 | 0.030 | 0.04 |
| 2 | R' | 0.044 | 0.017 | 0.029 | 0.026 | 0.05 |
| 3 | R'' | 0.068 | 0.017 | 0.033 | 0.048 | 0.06 |

A comparison of trace metal contents in the test pellets of Table B with pellets in Table A shows a significant reduction in unwanted metals in the former. Table B further illustrates that the chlorinated hydrocarbon containing fuels (R' and R'') performed as well as the conventional fuel oil (R) in removing trace metals from iron oxide pellets.

EXAMPLE II

Two batches of iron calcine produced from iron pyrite were prepared into pellets for a second series of tests, dried in accordance with the method of Example I and labeled Samples Nos. 4 and 5. Each sample was analyzed to determine the average quantity of trace metals present in the pellets. Table C below provides the analysis of trace metals contained in pellet samples 4 and 5, prior to chloridization and induration:

TABLE C

| Sample No. | Chemical Analysis of Dried Pellets (%) Cu | Pb | Zn | S | $CaCl_2$ |
|---|---|---|---|---|---|
| 4 | 0.841 | 0.224 | 0.582 | 0.54 | 5.8 |
| 5 | 0.865 | 0.228 | 0.569 | 0.66 | 5.6 |

Pellet samples 4 and 5 were chloridized and indurated using the same equipment employed in treating samples 1–3 of Example I. However, the burner in the kiln was adjusted to impinge onto the pellet bed whereby the flame was deflected about 30° from the center axis of the kiln.

Sample 4 was exposed to a flame generated by burning Grade No. 4 heavy fuel oil (fuel R) and sample 5 was exposed to a flame generated from a chlorinated hydrocarbon by-product fuel having an elemental analysis of about 20% chlorine, about 70% carbon and about 10% hydrogen, and a heat of combustion of 15,100 BTU/pound (Fuel R'). Kiln temperatures for this second series of tests ranged from as low as 520° C at the feed end to highs of up to 1170° C at the discharge end.

Pellets discharged from the kiln were cooled and analyzed for trace metal content. Table D below provides the chemical analysis of the trace metals contained in test samples 4 and 5 subsequent to chloridization and induration:

TABLE D

| Sample (test) No. | Fuel | Chemical Analysis of Treated Pellets (%) Cu | Pb | Zn | S |
|---|---|---|---|---|---|
| 4 | R | 0.052 | 0.010 | 0.032 | 0.056 |
| 5 | R' | 0.019 | 0.007 | 0.010 | 0.040 |

The low trace metal content of sample 5 of Table D demonstrates that an impinged flame generated by the combustion of the chlorinated hydrocarbon fuel provides an improved means of removing trace metal impurities in iron oxide over conventional hydrocarbon fuels of Sample 4.

EXAMPLE III

The hot gases from the kiln of Examples I and II, containing the combustion products of the chlorinated hydrocarbon fuels, as well as the decomposition products of calcium chloride, volatilized metal chlorides and sulfur oxides are treated according to the following steps in order to recover the metal values and calcium chloride for incorporation into other pellets as a balling additive and supplemental chloridizing agent.

The kiln gases are humidified and cooled to about 175° F by contacting with a solution containing about 12% chloride. The solution is collected in a collection tank and recycled to a humidifier. The cooled gases are then further cooled and scrubbed in a packed tower and finally treated in an electrostatic precipitator to remove mist before being discharged to the atmosphere. The solution from the packed tower is cooled to about 120° F by passing it through a packed tower counter-current to air. Most of this solution, along with makeup water and drainage from the electrostatic precipitator are recycled to a scrubbing tower. The remainder is added to the humidifier collection tank. The quantity of solution fed to this tank is adequate to maintain level, compensating for losses by evaporation in adiabatically cooling the gases and for that withdrawn for recovery of chloride and metal values. The quantity withdrawn is regulated to maintain the chloride concentration at about 12 weight percent.

The solution withdrawn from the humidifier receiving tank is treated to recover metal values and calcium chloride for incorporation into pellets as a balling additive and supplemental chloridizing agent. The sulfates are first removed from this solution as gypsum by partially neutralizing with limestone and separating the solids. Neutralization is preferably carried out in three agitated tanks with 70% of the limestone added to the first tank, 30% added to the second, and the pH being controlled at about 1 at the exit from the third tank. The gypsum crystals are allowed to settle from solution in a thickener, the settled sludge is filtered and the solids washed. The thickener overflow and filtrate are combined for subsequent processing and the filter cake is discharged for disposal.

After removing the sulfate, copper is precipitated by reaction with metallic iron and recovered by sedimentation and filtration. The decopperized solution is adjusted to a pH of 5 with lime hydrate and simultaneously aerated to oxidize and precipitate the iron as a hydrated ferric oxide. The precipitated iron compound is allowed to settle from solution in a thickener, the settled sludge is filtered and the solids washed. The thickener overflow and filtrate are combined for subsequent recovery of zinc and calcium chloride. The precipitated iron filter cake is discharged for disposal or recycled to the pelletizing step.

The copper and iron-free solution is further neutralized with hydrated lime to a pH of 7.2 to precipitate a basic zinc chloride, which is allowed to settle in a thickener. The settled sludge is filtered and washed. The thickener overflow and filtrate, consisting primarily of a dilute solution of calcium chloride, is subsequently concentrated by evaporation in a multiple effect evaporator to about 34% calcium chloride. This solution is blended with pyrite cinder in preparation of new pellets.

While the invention has been described in conjunction with specific examples thereof, this is illustrative only. Accordingly, many alternatives, modifications and variations will be apparent to those skilled in the art in light of the foregoing description and it is therefore intended to embrace all such alternatives, modifications and variations as to fall within the spirit and broad scope of the appended claims.

I claim:

1. In a process of the purification of iron oxide normally using conventional fuels and conventional chlorinating agents and having the steps of:

a. Adding to the iron oxide a sufficient amount of binder, b. Pelletizing the resulting mixture, c. Drying the pellets and d. Indurating the pellets to a temperature ranging from about 1200° C to about 1250° C and concurrently chlorinating the pellets using a conventional chlorinating agent:

the improvement comprising indurating and concurrently chlorinating the pellets using heat and chlorine valves generated by combustion of a chlorinated hydrocarbon fuel having a heat of combustion of at least about 11,000 BTU/pound, said fuel comprising a mixture of chlorinated organic compounds having a combined elemental analysis of about 56% to about 87% carbon and about 9% to about 15% hydrogen and about 1% to about 35% chlorine.

2. The process of claim 1 wherein combustion of the fuel provides an atmosphere having at least 0.1% hydrogen chloride.

3. The process of claim 2 wherein the elemental analysis of the fuel is about 69% to about 78% carbon, about 11% to about 14% hydrogen and about 8% to about 20% chlorine.

4. The process of claim 2 wherein the iron oxide is material selected from the group consisting of iron ore, iron oxide dust, roaster calcine, waste heat boiler solids and mixtures thereof.

5. The process of claim 1 wherein said binder is selected from the group consisting of calcium chloride, ferrous chloride, calcium hydroxide, calcium oxide, silica, fayalite slag, and mixtures thereof.

6. The process of claim 5 wherein the binder is calcium chloride.

7. The process of claim 6 wherein off-gases generated by the process contain an excess of chlorine values to generate a sufficient amount of the calcium chloride for addition to new iron oxide.

8. The process of claim 6 wherein the flame is impinged on a bed of the iron oxide.

9. In a process for the purification of iron oxide normally using conventional fuels and conventional chlorinating agents and having the steps of:

a. Adding to the iron oxide a sufficient amount of binder, b. Pelletizing the resulting mixture, c. Drying the pellets and d. Indurating the pellets to a temperature ranging from about 1200° C to about 1250° C and concurrently chlorinating the pellets using a conventional chlorinating agent:

the improvement comprising indurating and concurrently chlorinating the pellets using heat and chlorine values generated by combustion of a blended fuel mixture, said mixture comprising a highly chlorinated hydrocarbon fuel having a heat of combustion of under about 11,000 BTU/pound, and a sufficient amount of partially chlorinated hydrocarbon fuel to increase the heat of combustion of the final blended fuel mixture to at least about 12,000 BTU/pound, the highly chlorinated hydrocarbon fuel being comprised of a mixture of chlorinated organic compounds having a combined elemental analysis of about 28% to about 56% carbon, about 2% to about 8% hydrogen and about 36% to about 70% chlorine, the partially chlorinated hydrocarbon fuel being comprised of a mixture of chlorinated organic compounds having a combined elemental analysis of about 56% to about 87% carbon, about 9% to about 12% hydrogen and about 1% to about 35% chlorine.

10. The process of claim 9 wherein the final blended fuel mixture includes a sufficient amount of a fuel oil to elevate the heat of combustion of said mixture to at least about 14,000 BTU/pound.

11. The process of claim 9 wherein the partially chlorinated hydrocarbon fuel has an elemental analysis of about 69% to about 78% carbon, about 11% to about 14% hydrogen and about 8% to 20% chlorine.

12. The process of claim 11 wherein the iron oxide is prepared from a material selected from the group consisting of iron ore, iron oxide dust, roaster calcine, waste heat boiler solids and mixtures thereof.

13. The process of claim 11 wherein said binder is selected from the group consisting of calcium chloride, ferrous chloride, calcium hydroxide, calcium oxide, silica, fayalite slag and mixtures thereof.

14. The process of claim 13 wherein the binder is calcium chloride.

15. The process of claim 14 wherein off-gases generated by the process contain an excess of chlorine values to generate a sufficient amount of the calcium chloride for addition to new iron oxide.

16. The process of claim 14 wherein the flame is impinged on a bed of the pelletized iron oxide.

17. In a process for the purification of iron oxide normally using conventional fuels and conventional chlorinating agents and having the steps of:

a. Adding to the iron oxide a sufficient amount of a binder, b. Pelletizing the resulting mixture, c. Drying the pellets and d. Indurating the pellets to a temperature ranging from about 1200° C to about 1250° C and concurrently chlorinating the pellets using a conventional chlorinating agent:

the improvement comprising indurating and concurrently chlorinating the pellets using heat and chlorine values generated by the combustion of a blended fuel mixture, said fuel mixture being comprised of a highly chlorinated hydrocarbon fuel having a heat of combustion of at least about 4,000 BTU/pound and a sufficient amount of fuel oil to provide the final blended fuel mixture with a heat of combustion of at least about 12,000 BTU/pound, said highly chlorinated hydrocarbon fuel being comprised of a mixture of chlorinated organic compounds having a combined elemental analysis of about 20% to 56% carbon, about 2% to about 8% hydrogen and about 36% to about 70% chlorine.

18. The process of claim 17 wherein the final blended fuel mixture includes a partially chlorinated hydrocarbon fuel in an amount sufficient to elevate the heat of combustion of said mixture to at least about 15,000 BTU/pound said chlorinated hydrocarbon fuel comprising a mixture of organic compounds having a combined elemental analysis of about 56% to about 87% carbon, about 9% to about 15% hydrogen and about 1% to about 35% chlorine.

19. The process of claim 18 wherein combustion of the fuel mixture provides an atmosphere having at least 0.1% hydrogen chloride.

20. The process of claim 19 wherein the iron oxide is a material selected from the group consisting of iron ore, iron oxide dust, roaster calcine, waste heat boiler solids and mixtures thereof.

21. The process of claim 19 wherein said binder is selected from the group consisting of calcium chloride, ferrous chloride, calcium hydroxide, calcium oxide, silica, fayalite slag and mixtures thereof.

22. The process of claim 21 wherein the binder is calcium chloride.

23. The process of claim 22 wherein off-gases generated by the process contain an excess of chlorine values to generate a sufficient amount of the calcium chloride for addition to new iron oxide.

24. The process of claim 22 wherein the flame is impinged on a bed of the pelletized iron oxide.

25. A method for disposing of chlorinated hydrocarbon by-products, which comprises burning said by-products as fuel in the presence of iron oxide having trace metal impurities to chloridize and indurate the iron oxide, said fuel providing a heat of combustion of at least about 11,000 BTU/pound and comprising a mixture of chlorinated organic compounds having a combined elemental analysis of about 56% to about 87% by weight carbon, about 9% to about 15% by weight hydrogen and about 1% to about 35% by weight chlorine.

26. The method of claim 25 wherein the elemental analysis of said fuel is about 69% to about 78% carbon, about 11% to about 14% hydrogen and about 8% to about 20% chlorine.

27. A method for disposing of chlorinated hydrocarbon by-products, which comprises burning said by-products as fuel in the presence of iron oxide having trace metal impurities to chloridize and indurate the iron oxide, said fuel being a mixture comprising (1) a highly chlorinated hydrocarbon fuel having a heat of combustion of under about 11,000 BTU/pound and (2) a sufficient amount of a partially chlorinated hydrocarbon fuel to increase the heat of combustion of the final blended fuel to at least about 12,000 BTU/pound, the highly chlorinated hydrocarbon fuel being comprised of a mixture of chlorinated organic compounds having a combined elemental analysis of about 28% to about 56% carbon, about 2% to about 8% hydrogen and about 36% to about 70% chlorine, the partially chlorinated hydrocarbon fuel comprising a mixture of chlorinated organic compounds having a combined elemental analysis of about 56% to about 87% carbon, about 9% to about 15% hydrogen and about 1% to about 35% chlorine.

* * * * *